United States Patent [19]

Flynn

[11] 4,097,079

[45] Jun. 27, 1978

[54] WINDOW LOCKING APPARATUS

[76] Inventor: Jean Louis Flynn, P.O. Box 1868, Deland, Fla. 32720

[21] Appl. No.: 772,726

[22] Filed: Feb. 28, 1977

[51] Int. Cl.[2] ..... E05C 19/04

[52] U.S. Cl. ..... 292/239; 292/261

[58] Field of Search ..... 292/261, 193, 252, 342, 292/299, DIG. 7, 239

[56] References Cited

U.S. PATENT DOCUMENTS

| | | | |
|---|---|---|---|
| 454,513 | 6/1891 | Beisel | 292/193 |
| 455,215 | 6/1891 | Kidd | 292/193 |
| 1,178,980 | 4/1916 | Whitehurst et al. | 292/299 |
| 1,333,272 | 3/1920 | Minns | 292/261 X |
| 2,217,035 | 10/1940 | Weagant | 292/261 X |

*Primary Examiner*—Richard E. Moore

*Attorney, Agent, or Firm*—Duckworth, Hobby, Allen & Pettis

[57] ABSTRACT

A window locking mechanism includes a flanged bracket in which the flange is attached to the window so that the remainder of the bracket protrudes over the window frame. The locking bracket is in a shape to support a disc shaped locking member, loosely supported on a center pin and adapted to wedge between an angled side of the support bracket in the window frame at all times except when the disc is lifted to prevent wedging.

3 Claims, 2 Drawing Figures

WINDOW LOCKING APPARATUS

BACKGROUND OF THE INVENTION

The present invention relates to window locks, and especially to locks for double hung windows, or the like, which can be readily attached to an existing window for providing additional security against the opening of the window.

In the past, a great variety of window locks have been provided for locking double hung windows, or the like, which includes the standard locking members for locking the windows together at their intersection in which a rotatable sliding member attached to one window of a double hung window is slid into a locking bracket on the other window for locking the two together. This standard lock, however, is easily broken by inexperienced persons who can by the simple application of a lever to the bottom of the double hung window can apply a force having a mechanical advantage directly against the screws holding the bracket to the window. Other devices holding the two windows together can be easily overcome by breaking or cutting through the window pane and reaching in to unlock the window. In addition, there has been a great deal of electronic burglar alrams for attaching to windows to detect the opening of windows. The present invention on the other hand, teaches a simple locking mechanism which can be inexpensively manufactured and quickly attached in an existing window by the average home owner which securely locks the window at all times, and in any position, except when lowering the window the lock is disengaged by the person operating the window.

SUMMARY OF THE INVENTION

The present invention relates to a window locking mechanism having a bracket with a flange portion having openings therein for attaching the bracket to a window with simple screws. The remaining portion of the bracket extends from the window over the window frame. The remaining portion of the bracket provides support for a locking disc held by the bracket by a pin attached to the bracket and passing through the locking disc. One side of the bracket is angled so that the blocking disc wedges between the angled side and the window frame to prevent raising of the window unless the loosely held disc is lifted to prevent it wedging against the window frame. A plurality of discs may be used and the bracket may be shaped to provide access to the bottom of the disc for lifting the disc to prevent wedging.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
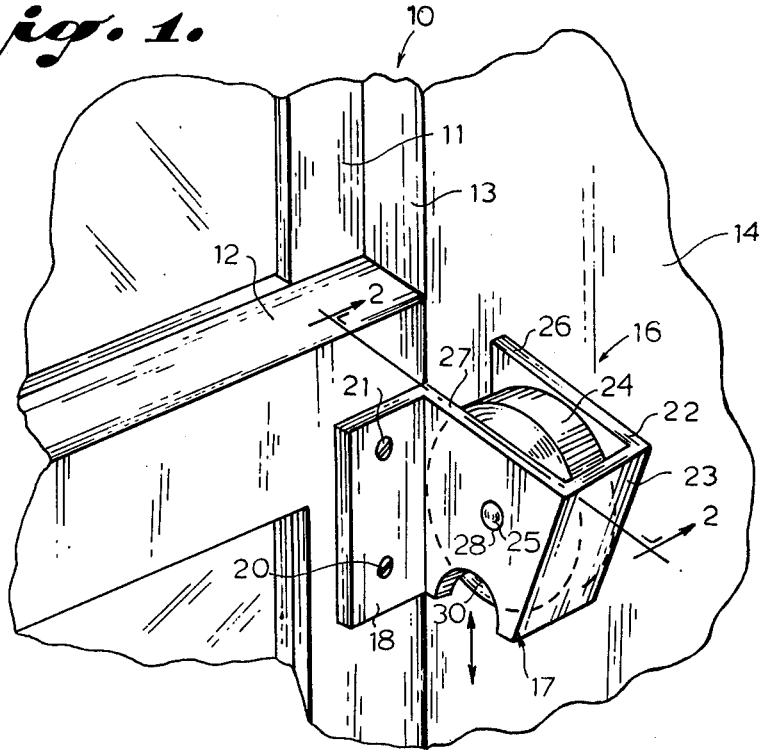
FIG. 1 is a perspective view of a window locking mechanism in accordance with the present invention attached to a window.
Figure 2:
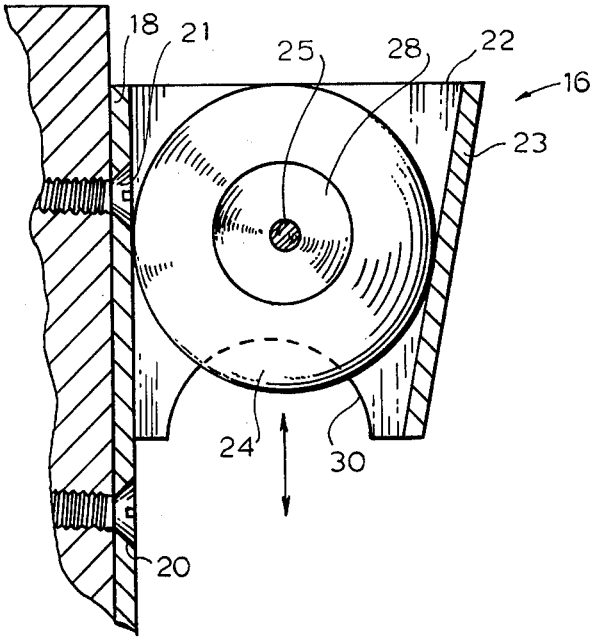
FIG. 2 is a sectional view taken on the Line 2 to FIG. 1.

Referring now to the drawings, a double hung window 10 is indicated as having a top window 11 and a bottom window 12, sliding in a jam 13 attached to the side window frame 14. The windows have glass 15 therein and the window locking mechanism 16 of the present invention attached thereto. The marking mechanism 16 has a bracket 17 having a flanged portion 18 having a pair of holes 20 therein. The flange portion 18 is attached to the bottom window 12 by a plurality of screws 21 adjacent the side window frame 14 so that the locking portion of the bracket 22 extends over the window frame 14 and forms a generally U-shaped structure having an angled side 23 slanted downward. The bracket 17 supports a plurality of locking discs 24 which may be supported by support pin 25 attached between sides 26 and 27 of the locking bracket 17. The plurality of discs 24 have an enlarged opening 28 for fitting onto the pin 25 in a manner that they cannot only rotate but can be lifted in a linear direction with the operator's finger through the unlocking arcuate bottom portion 30. Thus, in operation, the window 12 will always be wedged by the disc 24 between the window frame 14 and the angled wall 23 to prevent lifting of the window 12 until an operator places his finger in the arcuate unlocking portion 30 of the bracket 17 and lifts the locking disc 24 to allow the raising of the window. The present invention, advantageously, can be simply and easily manufactured and is readily adapted to be attached to a window by the average home owner without special tools and equipment. The window locking mechanism 16 can be made of any materials desired, but typically the bracket 17 would be made of steel with a steel pin 25 supporting disc of steel, aluminum or any other material desired, such as a plastic or rubber disc.

It should be clear at this point that a simplified window locking mechanism has been provided. However, it should also be clear that other embodiments and changes are contemplated as being within the spirit and scope of the invention. Accordingly, the present invention is not to be construed as limited to the particular forms disclosed herein which are to be considered illustrative rather than restrictive.

I claim:

1. A window locking mechanism comprising in combination:

bracket means having a flanged portion attachable to a window and having a supporting portion protruding over a window frame, when said flanged portion is attached to a window, said supporting portion having one angled side, and a supporting pin attached thereto; at least one disc shaped locking member rotably supported in said supporting portion on said supporting pin of said bracket means and being linearly shiftable therein, whereby said locking disc member will wedge between said angled member of said supporting portion of said bracket means and a window frame when said flanged portion is attached to a window having an opening force applied thereagainst; said locking member having a large center opening, larger than said supporting pin to thereby allow said disc to rotate on said supporting pin and to be lifted linearly thereon; and said bracket means supporting portion having an arcuate portion formed therein with said locking member protruding thereinto so that an operator's finger can lift the locking member for disengaging the window locking mechanism.

2. The apparatus in accordance with claim 1, in which said bracket means flanged portion has a plurality of holes therein for attaching said bracket means to a window by screws.

3. The apparatus in accordance with claim 1, in which said bracket means supporting portion is generally U-shaped having an angled side adapted to face the window frame for wedging said locking member thereagainst and against said window frame.

* * * * *